US010798987B2

(12) United States Patent
Silvester et al.

(10) Patent No.: US 10,798,987 B2
(45) Date of Patent: Oct. 13, 2020

(54) FOOTWEAR FOR USE ON SAND AND OTHER GRANULAR TERRAIN

(71) Applicants: James R. Silvester, Atlanta, GA (US); John C. Evans, Sandy Springs, GA (US)

(72) Inventors: James R. Silvester, Atlanta, GA (US); John C. Evans, Sandy Springs, GA (US)

(73) Assignee: James R. Silvester, Atlanta, GA (US)

( * ) Notice: Subject to any disclaimer, the term of this patent is extended or adjusted under 35 U.S.C. 154(b) by 0 days.

(21) Appl. No.: 16/664,847

(22) Filed: Oct. 26, 2019

(65) Prior Publication Data

US 2020/0128904 A1 Apr. 30, 2020

Related U.S. Application Data

(60) Provisional application No. 62/751,342, filed on Oct. 26, 2018.

(51) Int. Cl.

| | |
|---|---|
| ***A43B 3/00*** | (2006.01) |
| ***A43B 3/12*** | (2006.01) |
| ***A43B 7/00*** | (2006.01) |

(52) U.S. Cl.

CPC ..... *A43B 3/0036* (2013.01); *A43B 3/0078* (2013.01); *A43B 3/128* (2013.01); *A43B 7/00* (2013.01)

(58) Field of Classification Search

CPC ..... A43B 3/0036; A43B 3/0042; A43B 3/128; A43B 3/0026

(Continued)

(56) References Cited

U.S. PATENT DOCUMENTS 509,535 A * 11/1893 Hilker ..... A63B 31/14 441/61
915,457 A * 3/1909 Marrotte ..... A63B 31/11 441/64

(Continued)

FOREIGN PATENT DOCUMENTS

FR 2976460 A1 12/2012

OTHER PUBLICATIONS

PCT/US2019/058236, Filed: Oct. 26, 2019, First Named Applicant: Silvester, James R., International Search Report and Written Opinion of International Searching Authority, dated Jan. 9, 2020, Documents Attached; References from which are cited hereinabove.

*Primary Examiner* — Ted Kavanaugh
(74) *Attorney, Agent, or Firm* — Barry E. Kaplan, Esq.

(57) ABSTRACT

The subject matter of the present disclosure relates, in various embodiments, to improved footwear in the nature of sandals, shoes, sports shoes, running and jogging shoes, civilian and military boots, work boots and work shoes, water shoes, waders, and the like, for personal use in walking on sand and other granular terrain, each item of footwear comprising a distinctively profiled outsole. A left outsole profile is defined by a first radius, and a right outsole profile is defined by a second radius. A line connecting the center of each radius passes through and defines the centers of the side profiles of the outsole. A preferred toe-out or progressive angle of approximately six degrees helps ensure that the outsole, during use, is near the widest position for optimal left and right side balance.

20 Claims, 11 Drawing Sheets

(58) Field of Classification Search
USPC ..... 36/116
See application file for complete search history.

(56) References Cited

U.S. PATENT DOCUMENTS 982,316 A * 1/1911 Vagtborg ..... A63B 31/14 441/61
1,266,492 A * 5/1918 Kurrell et al. ..... A43B 5/18 36/7.5
1,360,995 A 12/1920 Anderson
2,430,466 A * 11/1947 Hedman ..... A63C 13/001 36/7.5
2,628,437 A 2/1953 Forsythe
2,720,714 A * 10/1955 Flynn ..... A43B 3/0026 36/7.5
3,057,085 A 10/1962 Rigsby
3,628,262 A * 12/1971 Stopek ..... A43B 3/00 36/7.5
3,913,243 A 10/1975 Arnold et al.
3,965,585 A 6/1976 Stewart
4,050,168 A * 9/1977 Pace ..... A43B 3/00 36/136
4,094,081 A * 6/1978 Reiner ..... A43B 3/0026 36/11.5
4,327,504 A * 5/1982 Welsch ..... A63C 13/005 36/122
4,525,941 A * 7/1985 Ruth, Jr. ..... A43B 5/18 36/116
4,592,152 A 6/1986 Wright et al.
D292,841 S 11/1987 Sexton et al.
5,078,633 A * 1/1992 Tolbert, Jr. ..... B63B 35/812 36/114
D326,949 S 6/1992 Beckley
5,181,873 A * 1/1993 Tolbert ..... B63B 35/812 36/114
5,367,794 A 11/1994 Adelstein et al.
5,794,368 A 8/1998 Kirby
6,405,458 B1 * 6/2002 Fleshman ..... A43B 3/30 36/103
7,284,341 B2 10/2007 Moseley
D576,397 S 9/2008 Couder
7,845,094 B1 12/2010 Gaskins, Jr.
D649,334 S 11/2011 Terry et al.
D670,491 S 11/2012 Ko et al.
D672,943 S 12/2012 Reddell
D718,920 S 12/2014 Jones et al.
2006/0096124 A1 5/2006 Moseley
2006/0117609 A1 * 6/2006 Guichard ..... A43B 13/143 36/116
2009/0064538 A1 3/2009 Roether et al.
2010/0146820 A1 * 6/2010 Ramirez ..... A43B 1/08 36/103
2010/0192416 A1 8/2010 Rees
2013/0139411 A1 * 6/2013 White ..... A43B 1/0027 36/136
2017/0280822 A1 * 10/2017 Langvin ..... A43B 3/26
2019/0343236 A1 * 11/2019 McGinnis ..... A43B 3/24

* cited by examiner

FOOTWEAR FOR USE ON SAND AND OTHER GRANULAR TERRAIN

CROSS-REFERENCE TO RELATED APPLICATION

The present Application is a U.S. Non-Provisional patent application Ser. No., which, pursuant to 35 U.S.C § 119(e), claims benefit of and priority to U.S. Provisional Patent Application Ser. No. 62/751,342, filed on Oct. 26, 2018, also entitled, "Footwear For Use On Sand And Other Granular Terrain," and which is incorporated in its entirety herein by reference.

TECHNICAL FIELD

The subject matter of the present disclosure relates, generally, to footwear for use on sand and other granular terrain. More particularly, the subject matter of the present disclosure relates to footwear in the nature of sandals, shoes, sports shoes, boots, and the like, for human use in walking on sand and other granular terrain, and/or for therapeutic uses, each item of footwear comprising a distinctively profiled outsole, all as set forth and described in greater detail hereinbelow.

BACKGROUND

During vacation months, people flock to beaches to spend wonderful, warm days in the sand and the sun. Others may spend their vacation time near wilderness streams or rivers. Others may spend their vacation time in and around lakes. In each of these locations, and in countless similar others, regardless of season, people have the desire or need to walk upon and/or to traverse ground that is covered in materials that make it difficult to walk.

Of course, sand often comprises small, worn pieces of rock, shell, and the like. Particle sizes may vary widely, from fine, soft, silt-like particles, such as one might find on the beaches of the Jersey shore, to coarse, larger pebbles and rocks, such as one might find along the banks of a mountain stream. It is further noted that mixtures, slurries, suspensions, and the like, such as may include or be comprised of soil, silt, clay, and/or mud, whether including significant water content or not, may cover the ground and make it difficult for one to stand or walk. Accordingly, for purposes of this disclosure, all such materials, regardless of the nature of the material components thereof, and regardless of the range of material component and/or particle size, will be considered and referred to as granular materials. All such granular materials are viewed as sharing the following characteristics: they can be found to cover a section of ground or terrain; and, they present an unstable, shifting, soft, unsteady, insecure, and/or potentially unsafe surface for a person to attempt to walk on, to stand upon, and/or to traverse. A terrain and/or surface comprising granular materials will be considered and referred to as granular surface(s) and/or granular terrain(s).

Attempting to stand on and navigate such granular surfaces can present a variety of challenges and risks. For example, in silt and/or soft sand, one's feet may sink into and/or be covered by the material of the granular surface, making it difficult to stand and to walk. Attempting to stand on or walk across any such granular surface or terrain may result in injuring one's ankle, knee, hip, back, or the like. One may become momentarily stuck or mired in-place, leading to an off-balance posture and an increased risk of falling.

The difficulties in standing or walking upon, or in trying to traverse, these kinds of granular surfaces or terrains may be compounded, of course, by the sometimes increasing unsteadiness caused by age or by infirmity. Notwithstanding, it is sometimes these very people who may wish to be, or who may need to be, in these environments for the benefit of their health; and, yet, these very individuals may be prevented from entering, and may be sidelined from, such pleasant environments, simply by reason of not being able to manage the physical challenges presented by standing and/or walking across the granular terrain.

The above-described difficulties and risks may be increased by one's bare feet. The reason is that the relatively small profile presented by one's foot cannot adequately spread one's weight over a large enough ground surface area to provide stability in view of the nature of the granular surface. Traditional footwear—although often enhancing one's stability on such surfaces by providing a slightly larger outsole having an increased surface area—generally does not provide sufficient outsole surface area to provide an appropriate degree of stability. This is because the outsole of traditional footwear closely follows the profile of the human foot; and, therefore, the traditional outsole simply does not provide a sufficiently large bearing surface to mitigate the above-described challenges.

Although various types of footwear, and/or devices for affixation to footwear, have been proposed in the prior art, none are seen to be particularly effective in solving the above-described problems. For example, while often seeking to increase the bearing surface area, such devices are often bulky and/or awkwardly shaped. Their proportions may be atypical within the experience of most users; and, so, they may be difficult for a user to become accustomed to wearing. Most often, such devices do not take into consideration the natural angular offset foot position of most users, and so the devices become uncomfortable to wear and to use. Many are so large, bulky, cumbersome, and/or unusually shaped that a user simply cannot avoid becoming entangled with, and/or tripping over, any of a variety of ordinary obstacles that may be near the user's walking path. Many simply are not aesthetically pleasing enough for a user to consider wearing the device in an environment where others are present.

Accordingly, there is a need for footwear in the nature of sandals, shoes, sports shoes, running and jogging shoes, civilian and military boots, work boots and work shoes, water shoes, waders, and the like, without limitation, for personal use in walking on sand and other granular terrain, each item of footwear comprising a distinctively profiled outsole. Such a distinctively profiled outsole should increase the bearing surface area of one's foot, so as to avoid or minimize the aforedescribed challenges and risks inherent in standing upon and walking across granular surfaces. It should provide an outsole profile that is aesthetically pleasing, while mitigating the risk that a user would become entangled with, and/or trip over, obstacles that may be near the user's feet. It should take into consideration the natural, angular offset foot position of most users, so the footwear is comfortable to wear and to use in any setting.

Accordingly, it is to the disclosure of such improved footwear in the nature of sandals, shoes, sports shoes, running and jogging shoes, civilian and military boots, work boots and work shoes, water shoes, waders, therapeutic versions of each and/or any of the above, and the like, without limitation, for personal use in walking on sand and other granular terrain, each item of footwear comprising a distinctively profiled outsole, that the present detailed disclosure is directed.

SUMMARY

The subject matter of the present disclosure relates, in various embodiments, to providing improved footwear in the nature of sandals, shoes, sports shoes, running and jogging shoes, civilian and military boots, work boots and work shoes, water shoes, waders, therapeutic versions of each and/or any of the above, and the like, without limitation, for personal use in walking on sand and other granular terrain, each item of footwear comprising a distinctively profiled outsole, wherein the above-described problems identified with regard to the prior art devices may be mitigated and/or largely solved.

According to some embodiments, and/or in various embodiments, the footwear of the present disclosure may provide an outsole having a rounded and/or curvilinear profile. The rounded and/or curvilinear profile aids in reducing the chances of snagging obstacles.

According to some embodiments, and/or in various embodiments, a left outsole profile is defined by a first radius, R1. A right outsole profile is defined by a second radius, R2. A line connecting the center of each radius R1, R2 passes through and defines the centers of the side profiles of the outsole.

According to some embodiments, and/or in various embodiments, the disclosed outsole provides a toe-out or progressive angle of between four and seven degrees, with a preferred toe-out or progressive angle of approximately six degrees. This toe-out or progressive angle helps ensure that the outsole, during use, is near the widest position for left and right side balance.

According to some embodiments, and/or in various embodiments, the disclosed footwear of the present disclosure may be fabricated from, or treated with, waterproof and/or water resistant materials. According to some embodiments, and/or in various embodiments, the disclosed footwear of the present disclosure may be fabricated from, or treated with, mold and/or mildew-proof and/or -resistant materials.

Although the subject matter of the present disclosure may find particular application to conventional forms of footwear, such as sandals, shoes, sports and running shoes, boots, and the like, without limitation, for personal use in walking on sand and other granular terrain, its use also and further may be extended to other non-conventional forms of footwear, such as military combat boots, water shoes, waders, work shoes and work boots, therapeutic versions of each and/or any of the above, and the like, without limitation.

These, and other, features, advantages, and benefits shown by the various embodiments of the footwear for personal use in walking on sand and other granular terrain, and/or for therapeutic uses, and the related processes for creating them, as set forth within the present disclosure, will become more apparent to those of ordinary skill in the art after review of the following Detailed Description of Illustrative Embodiments and Claims in light of the accompanying drawing Figures.

BRIEF DESCRIPTION OF THE DRAWINGS

Accordingly, the within disclosure will be best understood through consideration of, and with reference to, the following drawing Figures, viewed in conjunction with the Detailed Description of Illustrative Embodiments referring thereto, in which like reference numbers throughout the various Figures designate like structure, and in which.

Figure 1:
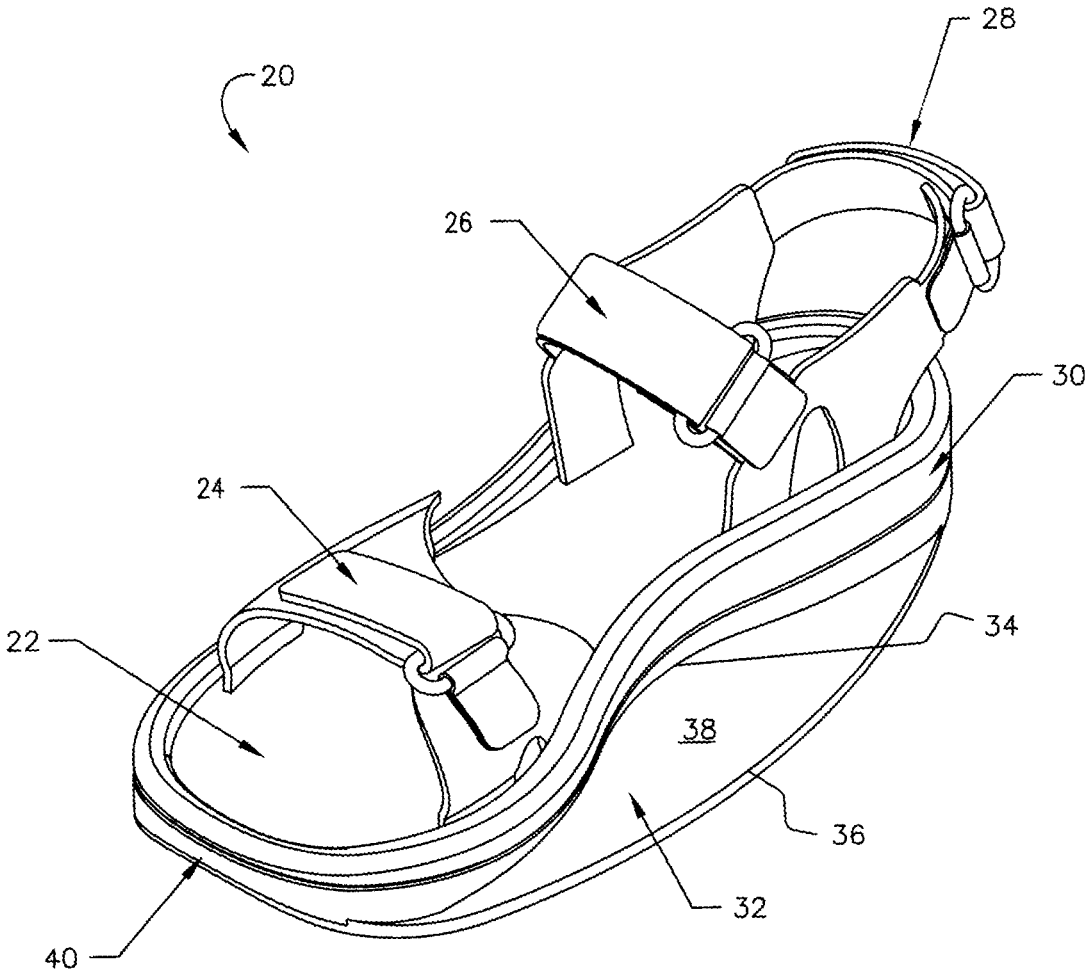
FIG. 1 depicts a front perspective view of an embodiment of the footwear for personal use in walking on sand and other granular terrain, in accordance with the subject matter of the present disclosure.

It is to be noted that the drawing Figures presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF ILLUSTRATIVE EMBODIMENTS

In describing the several embodiments illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose. Additionally, in the Figures, like reference numerals and like description shall be used to designate corresponding elements, parts, and functionality throughout the several Figures.

Turning now to the drawing Figures, generally, and specifically to FIG. 1, an embodiment of the footwear 20 for personal use in walking on sand and other granular terrain, in accordance with the subject matter of the present disclosure, is depicted. Although the selected embodiment of footwear 20 has been depicted as an open configuration, strapped sandal, it will be recognized by one of ordinary skill in the art that footwear 20 may take any of a variety of conventional and non-conventional forms, including, but not limited to, sandals, shoes, sports shoes, running and jogging shoes, civilian and military boots, work boots and work shoes, water shoes, waders, therapeutic versions of each and/or any of the above, and the like, without limitation.

In some embodiments, footwear 20 may be fabricated from, or treated with, waterproof and/or water resistant materials. In some embodiments, footwear 20 may be fabricated from, or treated with, mold and/or mildew-proof and/or -resistant materials.

Footwear 20 has insole 22. Affixed by conventional means to insole 22 are toe strap 24, instep strap 26, and heel strap 28. Each of toe strap 24, instep strap 26, and heel strap 28 may be outfitted with appropriately selected strap adjustment means, typically comprising D-type rings, hook and loop fasteners, and/or the like, as known in the art. Heel strap 28 may carry logo or other indicia (not shown) for purposes of brand, product, and/or other identification.

Footwear 20 further has midsole 30. Midsole 30 may provide appropriate foot profiles, contours, and boundaries. Midsole 30 may further provide appropriate padding and/or other comfort-directed features, as known in the art. Midsole 30 bridges between and interconnects insole 22 and distinctively profiled outsole 32.

As will be described hereinbelow in greater detail, outsole 32 has outsole inside edge 34 and outsole outside edge 36. Surface 38 bridges and interconnects outsole inside edge 34 and outsole outside edge 36. In some embodiments, surface 38 may taper upwards approximately eight degrees toward outsole inside edge 34. In such configuration, surface 38 adds strength to outsole 32. It should be noted that tapered surface 38 may be provided on each respective side of each item of footwear 20.

Figure 2:
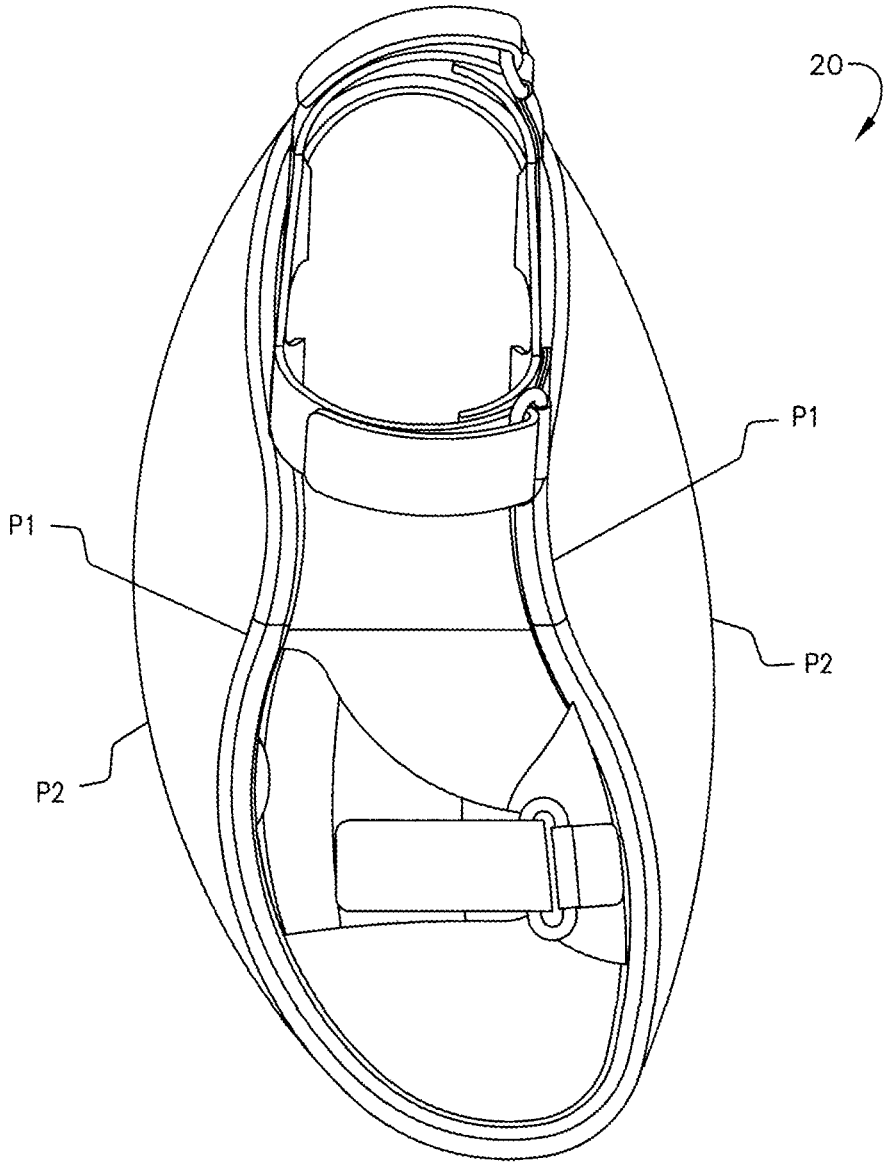
FIG. 2 depicts a top plan view of the footwear of FIG. 1, in accordance with the subject matter of the present disclosure.

Turning next to FIG. 2, typical profile P1 of a conventional beach shoe is depicted, and is extended, in accordance with the subject matter disclosure hereof, to depict curvilinear outsole profile P2 of footwear 20.

Figure 3:
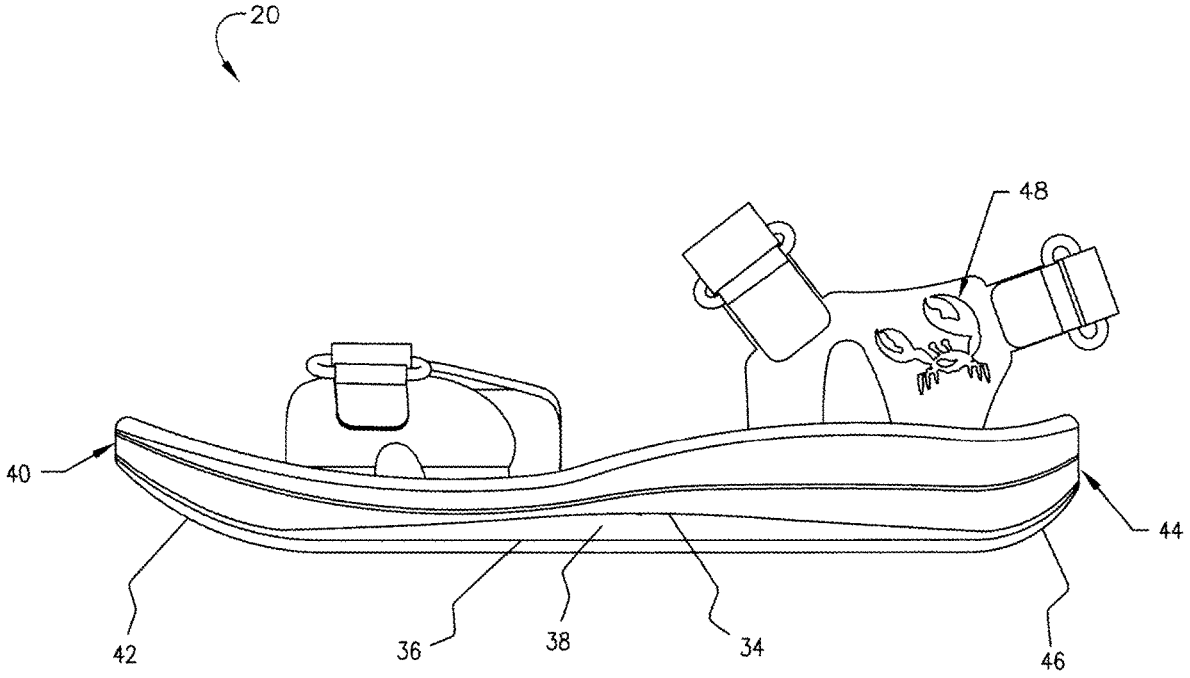
FIG. 3 depicts a right elevation view of the footwear of FIG. 1, in accordance with the subject matter of the present disclosure.
Figure 4:
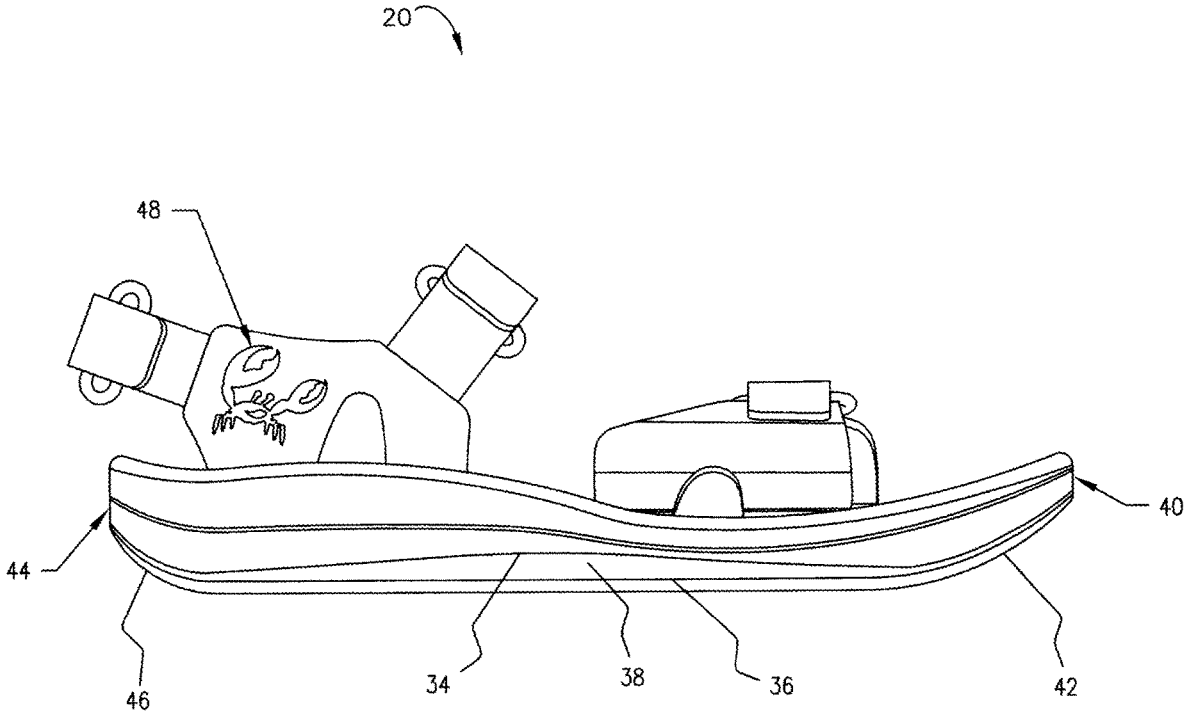
FIG. 4 depicts a left elevation view of the footwear of FIG. 1, in accordance with the subject matter of the present disclosure.

FIGS. 3 and 4 depict, respectively a right side and a left side of footwear 20, wherein may be seen different views of outsole inside edge 34, outsole outside edge 36, and tapered surface 38. At the front or fore of footwear 20 is toe 40. Toe 40 has rounded and/or curvilinear portion 42, which curves toward the bottom of footwear 20 in order to facilitate smooth walking. At the rear or aft of footwear 20 is heel 44. Like toe 40, heel 44 has rounded and/or curvilinear portion 46, which curves toward the bottom of footwear 20 in order to further facilitate smooth walking. Logo or other indicia 48 may be provided for purposes of brand, product, and/or other identification.

Figure 5:
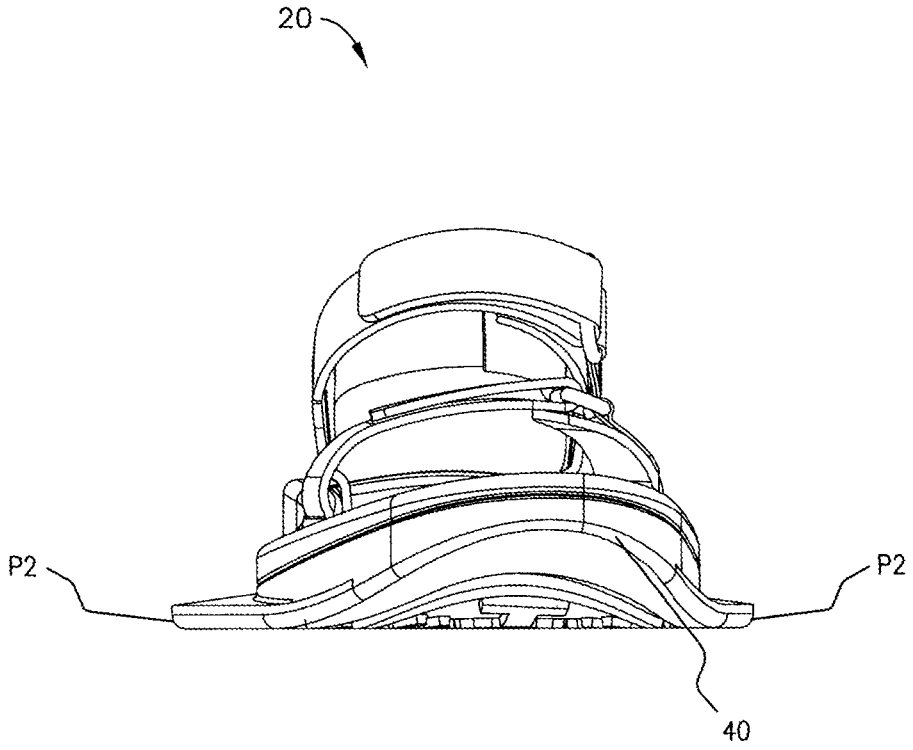
FIG. 5 depicts a front elevation view of the footwear of FIG. 1, in accordance with the subject matter of the present disclosure.
Figure 6:
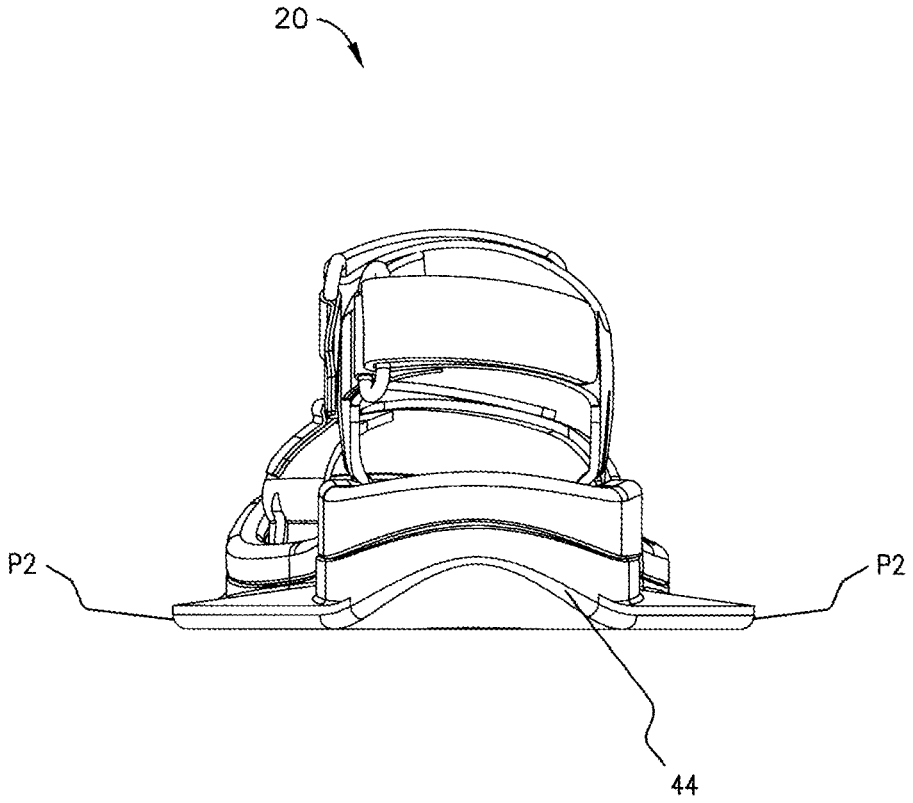
FIG. 6 depicts a rear elevation view of the footwear of FIG. 1, in accordance with the subject matter of the present disclosure.

FIG. 5 depicts a front elevation view of footwear 20. In FIG. 5 may further be seen the curvature of toe 40 and a different view of curvilinear outsole profile P2. Similarly, FIG. 6 depicts a rear elevation view of footwear 20, in which may further be seen the curvature of heel 44 and a different view of curvilinear outsole profile P2.

Figure 7:
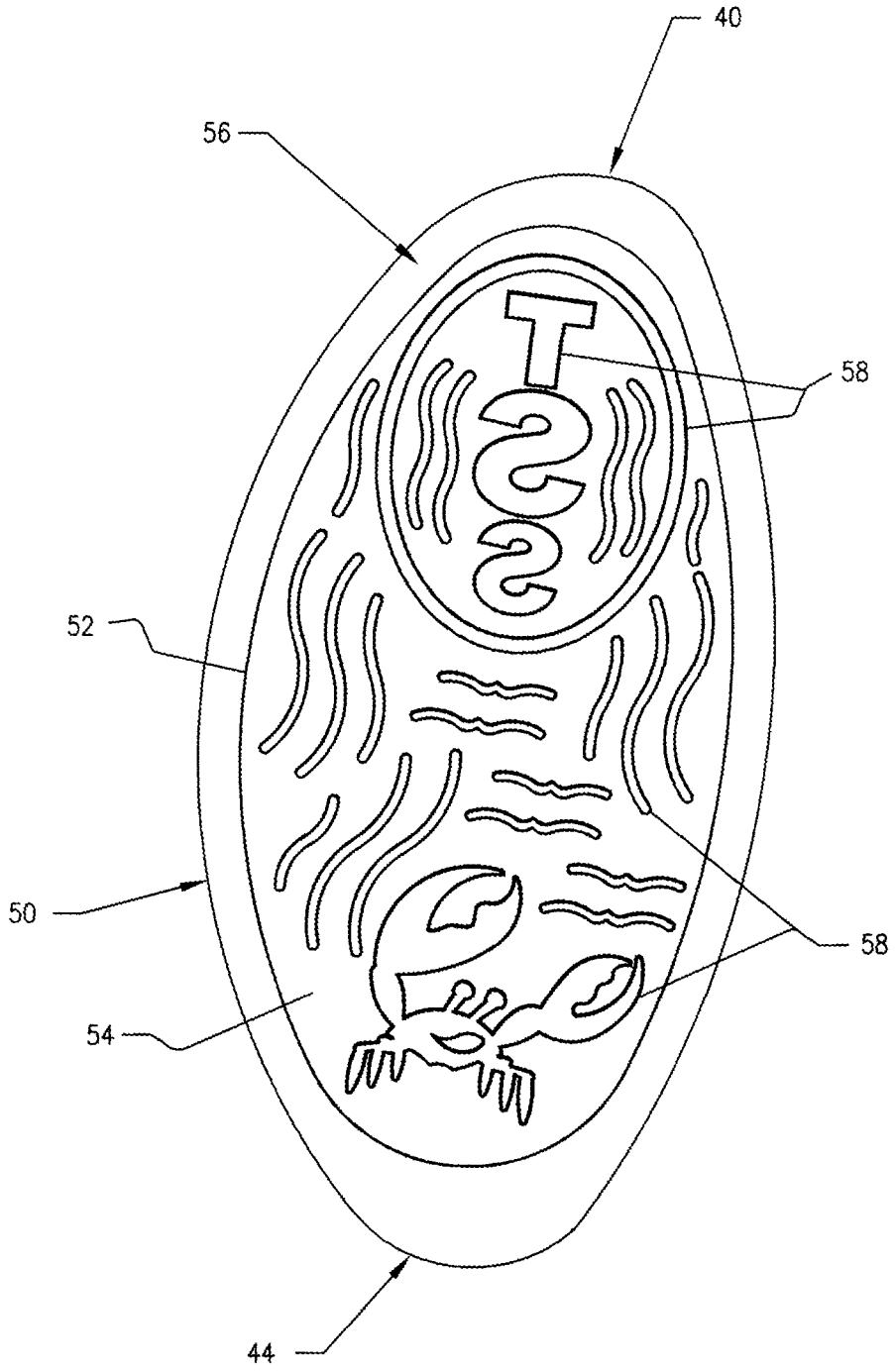
FIG. 7 depicts a bottom plan view of the footwear of FIG. 1, in accordance with the subject matter of the present disclosure.

Turning now to FIG. 7, a bottom plan view of outsole 32 is shown. Outsole perimeter 50 bounds recess perimeter 52. Recess perimeter, in turn, bounds recess 54. Spanning between outsole perimeter 50 and recess perimeter 52 is outsole bottom surface 56. Details 58 may be provided for additional surface traction of footwear 20.

Details 58 may be selected from any of a variety of shapes and/or designs, and may comprise any of a variety of sizes. Details 58 may comprise or may include logo or other indicia for purposes of brand, product, and/or other identification. As well, details 58 remain at the plane of outsole bottom surface 56. Accordingly, in cooperative association with recess 54, details 58 may be embossed, during ordinary use, into an underlying granular surface or terrain. This is especially the case when that granular surface or terrain comprises sand, silt, or other fine-grained material.

Advantageously, in some embodiments, and in some terrains (such as those comprising sandy surfaces, for example), it has been observed that, when the heel of footwear 20 contacts the ground during walking, the bottom of outsole 32 tends to bend downwardly with respect to the ground. In this configuration, and as the user's step proceeds, the bottom of outsole 32 tends to bulldoze the granular material there-beneath, and to mound it under the bottom of outsole 32. As the user's weight comes fully to bear, the granular material is spread and flattened within recess perimeter 52. This tends to compact and stabilize the weight bearing granular surface, and provides stability for the user. By contrast, a conventional shoe tends to allow the granular material to eject and/or escape at an otherwise arched portion of the shoe, which, then, tends to destabilize the user.

FIGS. 8-11 are provided to assist with an understanding of the design and construction of footwear 20, and to further provide an understanding of the geometric considerations attendant to the design and formation of outsole 32.

According to some embodiments, and/or in various embodiments, of footwear 20 disclosed outsole 32 provides a toe-out or progressive angle of between four and seven degrees, with a preferred toe-out or progressive angle of approximately six degrees. This toe-out or progressive angle helps ensure that outsole 32, during use, is oriented near the widest position for optimal left and right side balance of the user.

Figure 8:
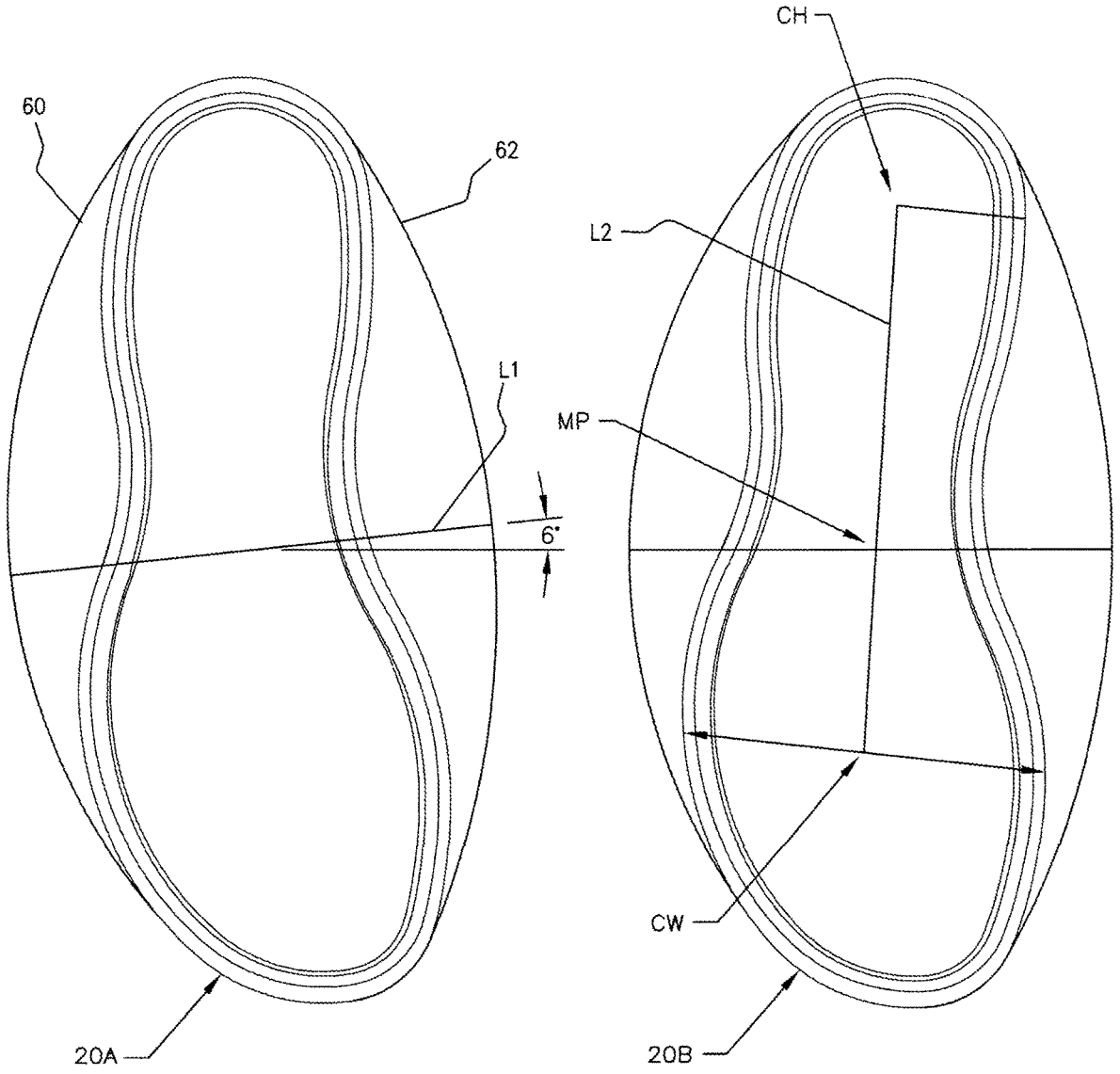
FIG. 8 depicts a top plan view of an aspect of the footwear of FIG. 1, in accordance with the subject matter of the present disclosure, and more particularly depicts certain features and geometry thereof.

With reference to FIG. 8, the leftmost figure depicts footwear 20A, shown with a zero degree toe-out or progressive angle. The rightmost figure depicts footwear 20B, shown with a preferred, approximately six degree toe-out or progressive angle. Best seen in the leftmost figure, circular profile 60 designates a profile of the left side of outsole 32. Similarly, circular profile 62 designates a profile of the right side of outsole 32. One may further observe that line L1 defines that certain line between the centers of respective left and right outsole profiles. Midpoint MP defines that certain midpoint of the section of line L1 between the centers of respective left and right outsole profiles. Line L2 defines that certain line between center of heel CH and center of the widest section of midsole CW, and it may further be seen that line L2 passes through midpoint MP of the section of line L1 between the respective outsole profiles.

Figure 9:
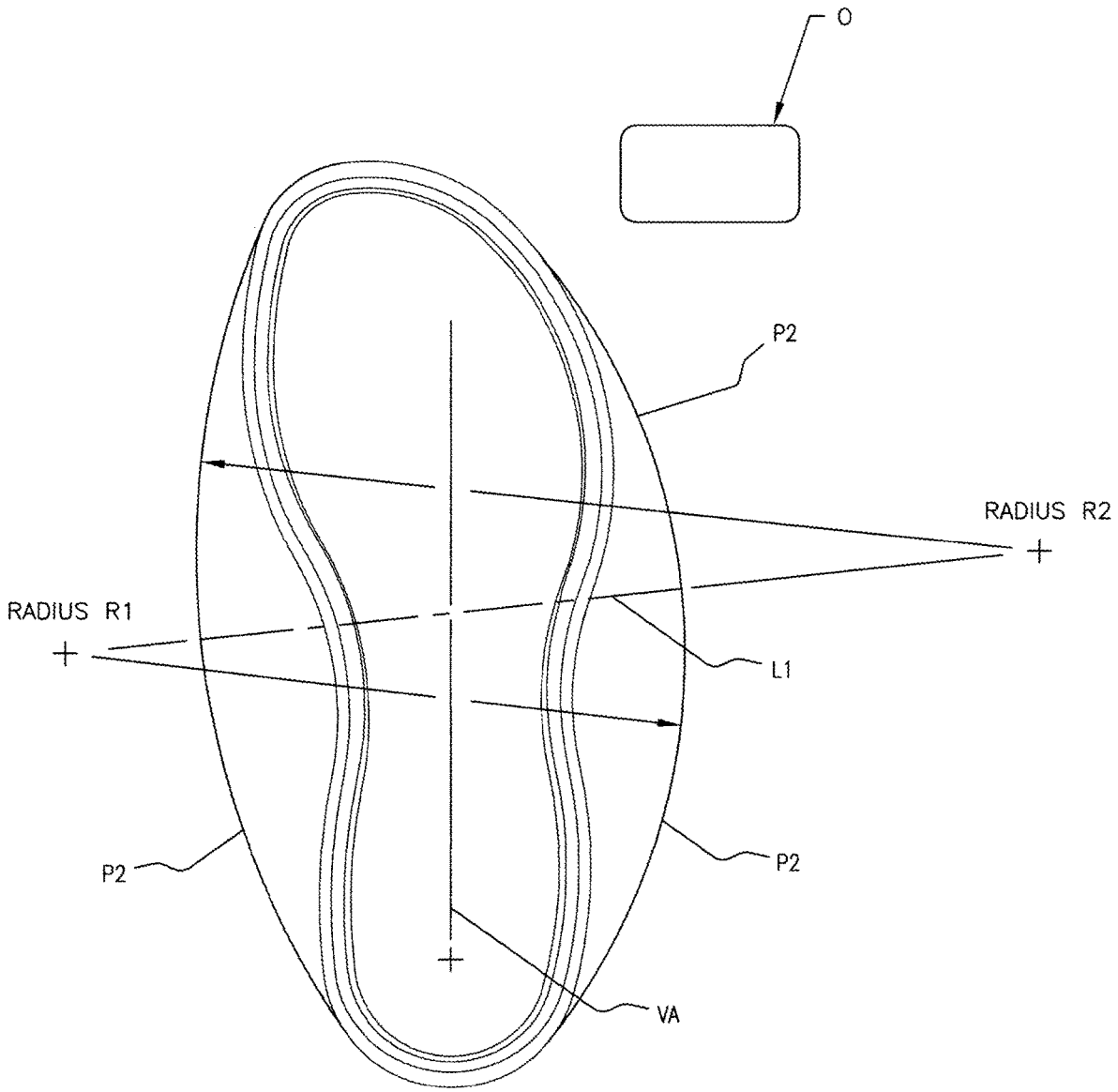
FIG. 9 depicts a top plan view of an aspect of the footwear of FIG. 1, in accordance with the subject matter of the present disclosure, and more particularly depicts certain features and geometry thereof.

Turning next to FIG. 9, it may now be seen that first radius R1 defines an outside outsole profile P2. On the other side, second radius R2 defines an inside outsole profile P2. In this figure, it may be seen that line L1 (see FIG. 8) passes through the centers of the outsole profiles on each respective side of each item of footwear 20. For design reference, it may be seen that line VA defines the vertical axis of footwear 20.

In FIG. 9, it may also be seen that rounded and/or curvilinear profile P2 of footwear 20 reduces the chance that a wearer of said footwear would inadvertently snag an obstacle O, such as a bench leg, during ordinary use.

Figure 10:
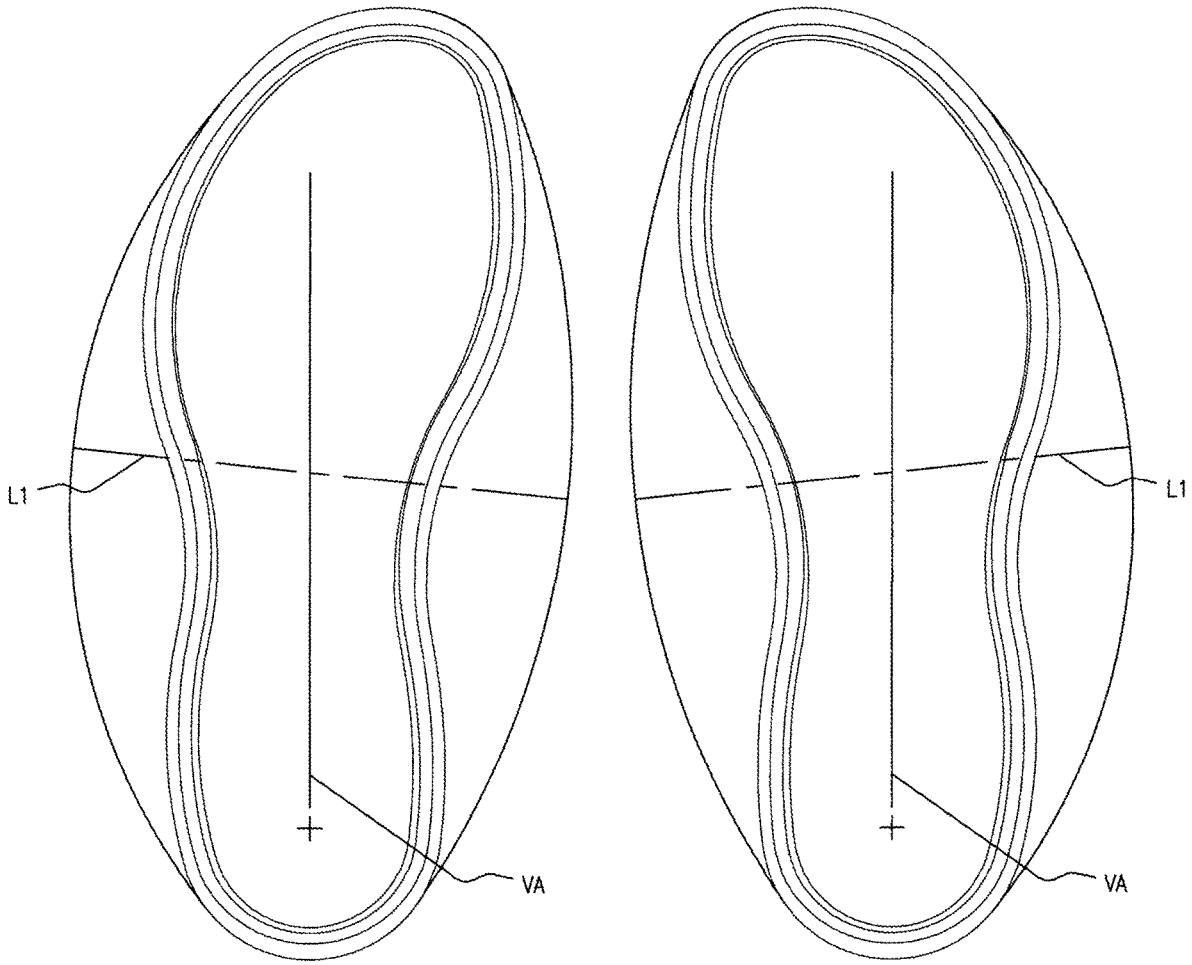
FIG. 10 depicts a top plan view of an aspect of the footwear of FIG. 1, in accordance with the subject matter of the present disclosure, and more particularly depicts certain features and geometry thereof; and, FIG. 11 depicts a top plan view of an aspect of the footwear of FIG. 1, in accordance with the subject matter of the present disclosure, and more particularly depicts certain features and geometry thereof.

Turning next to FIG. 10, footwear 20 is depicted as worn with a user's feet in true parallel alignment. Note the geometric relationship in this foot position between vertical axis line VA of footwear 20 and that of line L1. In this figure, one may better see the impact of a design wherein an appropriate toe-out or progressive angle has not been considered. In this regard, the widest portions of profile P2 are shifted from that design intent described hereinabove, such that the beneficial attributes of profile P2 are not properly oriented for optimal left and right side balance of the user.

Figure 11:
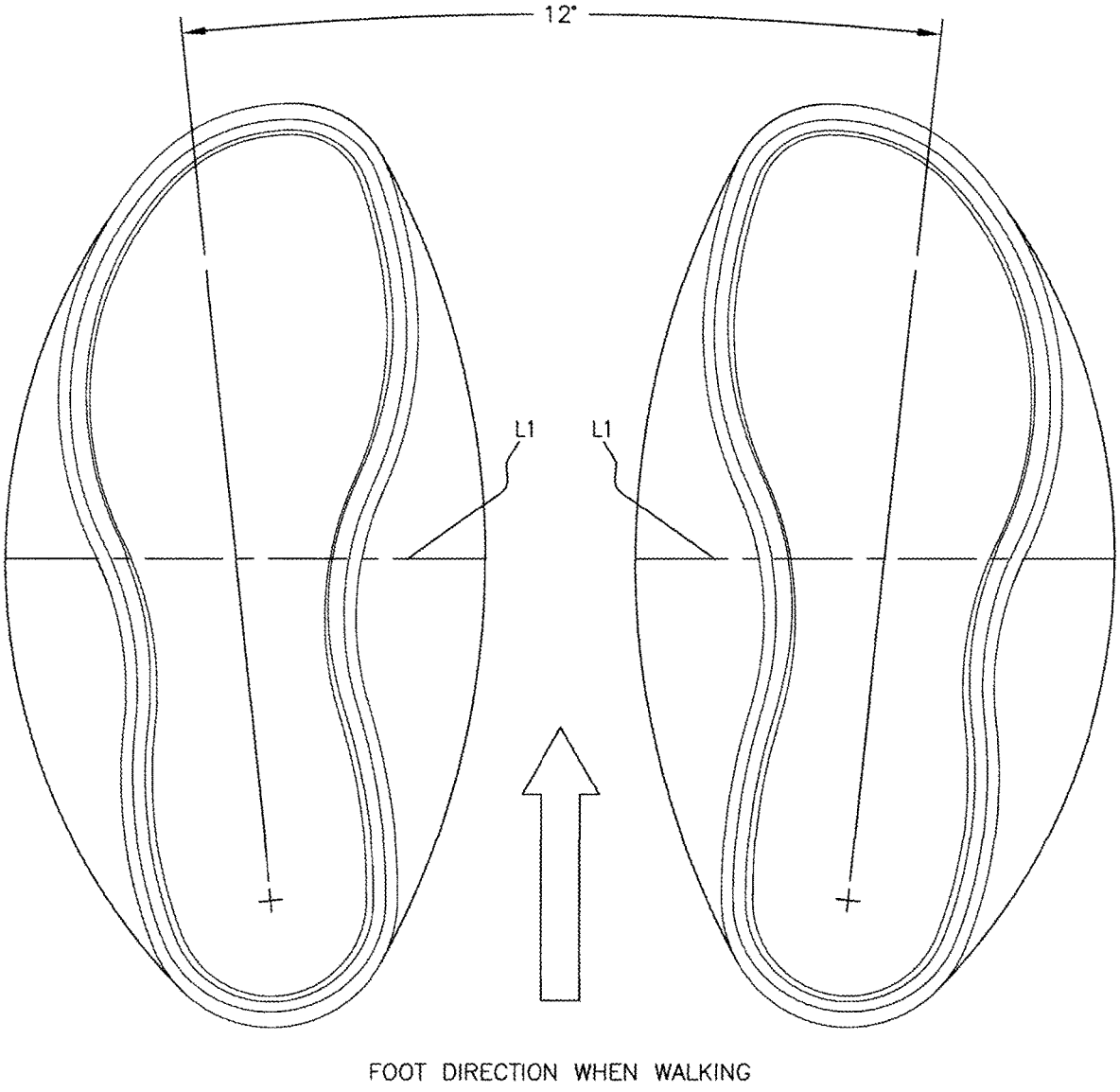

By comparison, we turn next to FIG. 11, wherein proper design and use attributes of footwear 20 can best be seen and appreciated. It is known that a large majority of people have a natural toe-out angle of between four and seven degrees. For this reason, respective outsole radii R1, R2 and, thus, the corresponding radius centers, are selected such that line L1 drawn through said centers would be horizontal when the toe-out angle is approximately six degrees. Said geometry ensures that outsole 32 of footwear 20 would be near the widest position for optimal left and right side balance of the user. In this figure, it may be observed that the total angular offset between respective left and right foot items of footwear 20 measures approximately twelve degrees.

With benefit of the detailed disclosure provided herein, it will be recognized by one of ordinary skill in the art that there are an extensive variety of uses and applications for the subject footwear. For example, the footwear of the present disclosure effectively and advantageously may improve a user's ability to walk, run, play, and/or work in diverse and varied environments, such as, but not limited to, sand, loose soil, mud, mud flats, grass, rice paddies, cranberry bogs, shellfish beds, areas with environmentally sensitive subaqueous conditions, wet concrete, and the like.

Additionally, it will be recognized that, during use, the wide outsole of the footwear of the present disclosure advantageously serves to reduce and/or minimize entry and collection of destabilizing materials, such as sand, mud, and/or the like, between the user's foot and the footwear's insole.

For convenience of the reader, following is a summary of parts referenced in the written Specification and Drawings hereof:

| Part Number | Part Description |
|---|---|
| 20 | Footwear |
| 22 | Insole |
| 24 | Toe Strap |
| 26 | Instep Strap |
| 28 | Heel Strap |
| 30 | Midsole |
| 32 | Outsole |
| 34 | Outsole Inside Edge |
| 36 | Outsole Outside Edge |
| 38 | Surface, Tapered |
| 40 | Toe |
| 42 | Rounded and/or Curvilinear Portion, Toe |
| 44 | Heel |
| 46 | Rounded and/or Curvilinear Portion, Heel |
| 48 | Indicia |
| 50 | Outsole Perimeter |
| 52 | Recess Perimeter |
| 54 | Recess |
| 56 | Outsole Bottom Surface |
| 58 | Details |
| 60 | Circular Profile, Left |
| 62 | Circular Profile, Right |
| P1 | Typical Profile, Conventional Beach Shoe |
| P2 | Outside Profile |
| L1 | Line, as Designated |
| L2 | Line, as Designated |
| CH | Center of Heel |
| CW | Center, Widest Section of Midsole |
| MP | Midpoint, as Designated |
| 20A | Footwear, Zero Degree Progressive Angle |
| 20B | Footwear, Six Degree Progressive Angle |

-continued

| Part Number | Part Description |
|---|---|
| R1 | First Radius, as Designated |
| R2 | Second Radius, as Designated |
| O | Obstacle |
| VA | Line, Vertical Axis, as Designated |

Having thus described exemplary embodiments of the subject matter of the present disclosure, it is noted that the within disclosures are exemplary only and that various other alternatives, adaptations, and modifications may be made within the scope and spirit of the present invention. Accordingly, the present subject matter is not limited to the specific embodiments as illustrated herein, but is limited only by the following claims.

What is claimed:

1. An item of footwear for use in walking on sand and other granular terrain comprising:

an outsole, said outsole comprising a toe portion and a heel portion;

said outsole further comprising a curvilinear profile;

said curvilinear profile comprising, at least in part, a first outsole profile, corresponding to an outside portion of a wearer's foot, defined by a first continuous radius sweeping between said toe portion and said heel portion and a second outsole profile, corresponding to an inside portion of a wearer's foot, defined by a second continuous radius sweeping between said toe portion and heel portion, said first radius being less than said second radius.

2. The item of footwear of claim 1, further comprising a toe-out or progressive angle between approximately four and seven degrees outside a hypothetical straight line direction of travel of a presumed wearer thereof.

3. The item of footwear of claim 2, wherein said toe-out or progressive angle is approximately six degrees outside a hypothetical straight line direction of travel of a presumed wearer thereof.

4. The item of footwear of claim 2, wherein said toe-out or progressive angle, when in configuration for use, orients a maximum width of said outsole, located approximately equidistant between said toe portion and said heel portion of said outsole, at a ground-adjacent position proximate the wearer's center of gravity, so as to provide enhanced user balance.

5. The item of footwear of claim 1, wherein said outsole comprises a taper angle of approximately eight degrees, measured between an outsole inside edge and an outsole outside edge.

6. The item of footwear of claim 1, wherein a bottom of said outsole comprises a bottom surface, a recess, and a feature.

7. The item of footwear of claim 6, wherein said bottom surface and a portion of said feature are approximately co-planar.

8. The item of footwear of claim 6, wherein said feature comprises an indicia.

9. The item of footwear of claim 1, wherein said footwear comprises waterproof or water resistant materials.

10. The item of footwear of claim 1, wherein said footwear comprises mold and mildew-proof or mold and mildew-resistant materials.

11. An item of footwear comprising:

an insole, a midsole, and an outsole, said outsole comprising a toe portion and a heel portion;

said outsole further comprising an outsole inside edge, an outsole outside edge, and a tapering surface therebetween;

said outsole further comprising a curvilinear profile;

said curvilinear profile comprising, at least in part, a first outsole profile, corresponding to an outside portion of a wearer's foot, defined by a first continuous radius sweeping between said toe portion and said heel portion and a second outsole profile, corresponding to an inside portion of a wearer's foot, defined by a second continuous radius sweeping between said toe portion and said heel portion, said first radius being less than said second radius.

12. The item of footwear of claim 11, wherein said tapering surface rises approximately eight degrees from said outsole outside edge to said outsole inside edge.

13. The item of footwear of claim 11 configured so as to provide said tapering surface on each of two respective sides of said item of footwear.

14. The item of footwear of claim 11 further comprising a toe portion, said toe portion configured to curve toward a bottom of said item of footwear.

15. The item of footwear of claim 11 further comprising a heel portion, said heel portion configured to curve toward a bottom of said item of footwear.

16. The item of footwear of claim 11, further comprising a toe-out or progressive angle between approximately four and seven degrees outside a hypothetical straight line direction of travel of a presumed wearer thereof.

17. The item of footwear of claim 16, wherein said toe-out or progressive angle is approximately six degrees outside a hypothetical straight line direction of travel of a presumed wearer thereof.

18. The item of footwear of claim 16, wherein said toe-out or progressive angle, when in configuration for use, orients a maximum width of said outsole, located approximately equidistant between said toe portion and said heel portion of said outsole, at a ground-adjacent position proximate the wearer's center of gravity, so as to provide enhanced user balance.

19. The item of footwear of claim 11, wherein a bottom of said outsole comprises a bottom surface, a recess, and a feature, and wherein said bottom surface and a portion of said feature are approximately co-planar.

20. An item of footwear comprising:

an insole, a midsole, and an outsole. said outsole comprising a toe portion and a heel portion;

said outsole further comprising a curvilinear profile, said curvilinear profile comprising, at least in part, a first outsole profile, corresponding to an outside portion of a wearer's foot, defined by a first continuous radius sweeping between said toe portion and said heel portion, and a second outsole profile, corresponding to an inside portion of a wearer's foot, defined by a second continuous radius sweeping between said toe portion and said heel portion, said first radius being less than said second radius;

said outsole configured to comprise a toe-out or progressive angle of between approximately four and seven degrees, such that, when said item of footwear is in configuration for use by a wearer thereof, said toe-out or progressive angle orients a maximum width of said outsole. located approximately equidistant between said toe portion and said heel portion of said outsole, at a ground-adjacent position proximate the wearer's center of gravity, so as to provide enhanced user balance.

* * * * *